US005757221A

United States Patent [19]

Hayashi

[11] Patent Number: 5,757,221

[45] Date of Patent: May 26, 1998

[54] ANALOG ARITHMETIC CIRCUIT

[75] Inventor: Mishio Hayashi, Menuma-machi, Japan

[73] Assignee: Advantest Corp., Tokyo, Japan

[21] Appl. No.: 652,840

[22] Filed: May 23, 1996

[30] Foreign Application Priority Data

May 23, 1995 [JP] Japan ..... 7-148332

[51] Int. Cl.[6] ..... G06G 7/16

[52] U.S. Cl. ..... 327/360; 327/345

[58] Field of Search ..... 327/344, 345, 327/360, 363

[56] References Cited

U.S. PATENT DOCUMENTS

| | | | |
|---|---|---|---|
| 3,493,738 | 2/1970 | Keller | 327/360 |
| 3,712,977 | 1/1973 | Rice, Jr. | 327/360 |
| 3,976,894 | 8/1976 | Perkins, Jr. et al. | 327/360 |
| 4,211,971 | 7/1980 | Kobayashi et al. | 327/360 |

FOREIGN PATENT DOCUMENTS

| | | | |
|---|---|---|---|
| 54-151347 | 11/1979 | Japan | 327/360 |

OTHER PUBLICATIONS

Van Oorschot, "Analogue divider and multiplier", Wireless World, vol. 84, No. 1505, p. 59, 1978.

*Primary Examiner*—Timothy P. Callahan
*Assistant Examiner*—T. T. Lam
*Attorney, Agent, or Firm*—Muramatsu & Associates

[57] ABSTRACT

An analog arithmetic circuit directly divides an input voltage by another input voltage with high accuracy without requiring a logarithmic conversion process or an adjustment process. The analog arithmetic circuit includes: an integrator for integrating a dividend signal and a feedback signal; a hysteresis comparator having two threshold levels to compare an output signal of the integrator and generates a comparison output; a limiter which receives the comparison output and a divisor signal and generates the feedback signal that is proportional to the divisor signal; an average circuit connected to an output of the hysteresis comparator to generates an average value of the comparison output as a quotient signal.

8 Claims, 3 Drawing Sheets

Fig. 1
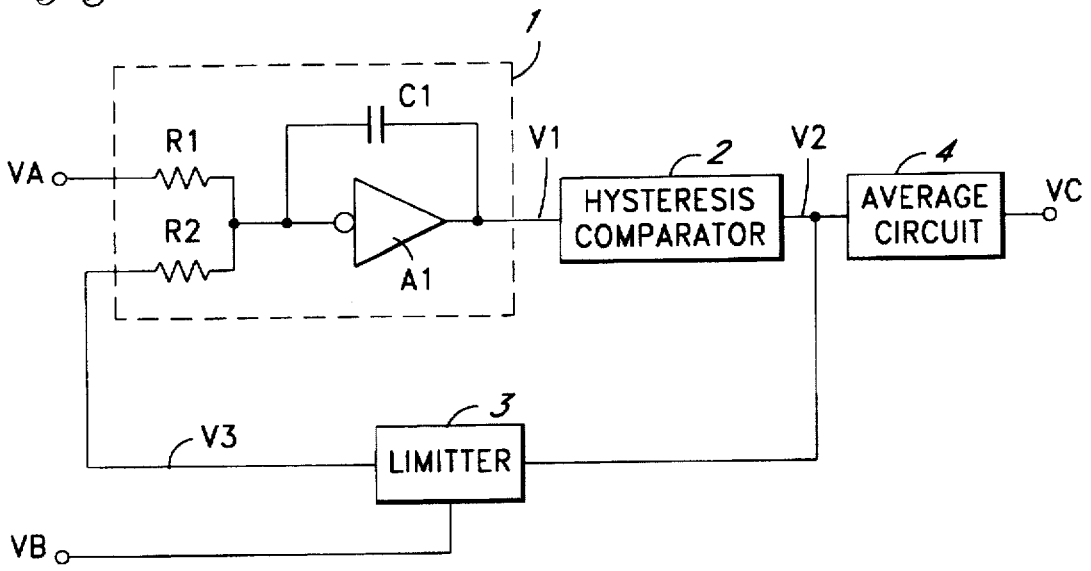
Fig. 2A
Fig. 2B
Fig. 2C
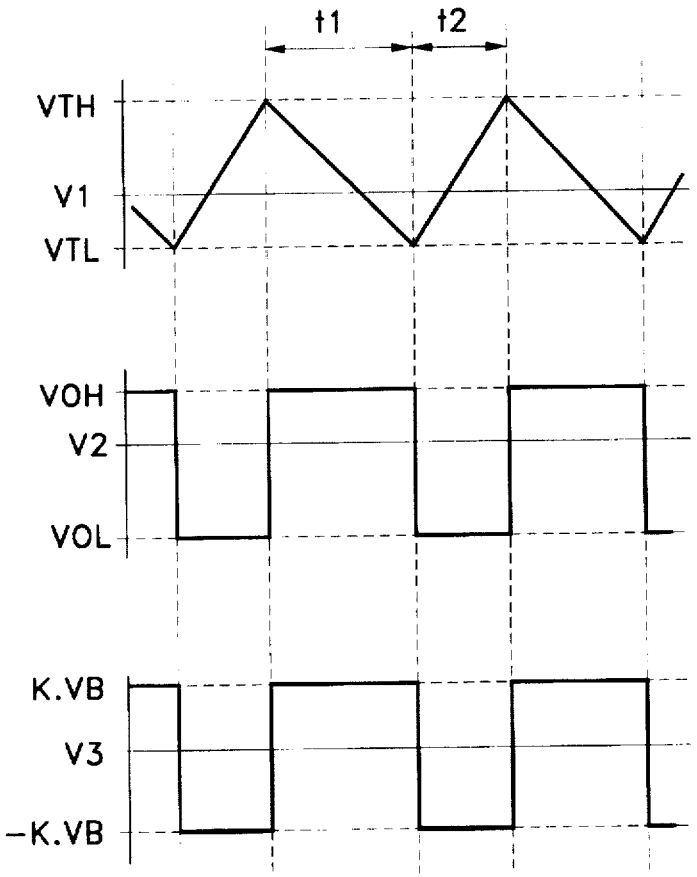

ANALOG ARITHMETIC CIRCUIT

FIELD OF THE INVENTION

This invention relates to an analog arithmetic circuit to be used in an electronics circuit for directly dividing an analog voltage with high accuracy.

BACKGROUND OF THE INVENTION

FIG. 6 shows a conventional analog division circuit having a logarithmic conversion circuit and an inverse logarithmic conversion circuit. An input voltage (dividend) VA and an input voltage (divisor) VB are converted to logarithms by a logarithmic converters 6 and 7, respectively. A difference between the outputs of the logarithmic converters 6 and 7 is obtained by a subtraction circuit 8. The results of the subtraction is converted to an antilogarithm by an inverse logarithmic converter 9 to produce an output voltage (arithmetic result) VC.

The input voltages VA and VB and the output voltage VC are related as expressed by the following equations.

$$VC=EXP\ (LOG(VA)-LOG(VB)) \quad (1)$$

$$VC=EXP\ (LOG(VA/VB) \quad (2)$$

$$VC=VA/VB \quad (3)$$

Thus, a quotient VC is obtained by the dividend VA and the divisor VB by the circuit configuration of FIG. 6.

The logarithmic conversion circuit and the inverse logarithmic conversion circuit used in the conventional analog division circuit utilize an exponential curve in a P-N junction of a semiconductor. As result, to attain an arithmetic error of 0.1% or less, an adjustment circuit, external or within a semiconductor chip is required. Thus, there is a need to obviate the adjustment procedure and to simplify the production process of the analog arithmetic circuits.

SUMMARY OF THE INVENTION

It is, therefore, an object of the present invention to provide an analog arithmetic circuit which is capable of directly dividing one input voltage by another input voltage without involving a logarithmic conversion process.

It is another object of the present invention to provide an analog arithmetic circuit which is capable of performing a division by a new circuit configuration including an oscillator, a hysteresis comparator and a limiter.

It is a further object of the present invention to provide an analog arithmetic circuit which is capable of directly dividing one input voltage by another input voltage with high accuracy without using high precision circuit components.

It is a further object of the present invention to provide an analog arithmetic circuit which is capable of directly dividing one input voltage by another input voltage with high accuracy without involving any adjustment.

In the present invention, the analog arithmetic circuit directly divides one input voltage by another voltage without using logarithmic converters. The analog division circuit of the present invention forms an oscillator wherein a quotient of the division is taken by averaging the output of the oscillator.

The analog arithmetic circuit of the present invention includes: an integrator for integrating a dividend signal and a feedback signal; a hysteresis comparator having two threshold levels to compare an output signal of the integrator and generates a comparison output; a limiter which receives the comparison output and a divisor signal and generates the feedback signal that is proportional to the divisor signal; an average circuit connected to an output of the hysteresis comparator to generates an average value of the comparison output as a quotient signal.

According to the present invention, the analog arithmetic circuit is capable of directly dividing one input voltage by another input voltage without involving a logarithmic conversion process. The analog arithmetic circuit performs a division by a new circuit configuration including an oscillator formed of an integrator, a hysteresis comparator and a limiter.

The analog arithmetic circuit of the present invention can divide one input voltage by another input voltage with high accuracy without using high precision circuit components. Further, the analog arithmetic circuit of the present invention is capable of directly dividing one input voltage by another input voltage with high accuracy without involving any adjustment circuit or adjustment process.

BRIEF DESCRIPTION OF THE DRAWINGS

FIG. 1 is a block diagram showing a structure of the analog arithmetic circuit of the present invention.

FIG. 2 is a timing chart showing an operation of the analog arithmetic circuit of FIG. 1.

DETAILED DESCRIPTION OF THE PREFERRED EMBODIMENT

First, referring to FIGS. 4 and 5, an oscillator which is fundamental to the present invention will be explained. The fundamental oscillator of FIG. 4 includes an integrator 1 and a hysteresis comparator 2 in a closed loop. The integrator 1 has an input resistor R19, a capacitor C12 and an operational amplifier A15. The integrator 1 provides an output voltage V1 to the hysteresis comparator 2 whose output voltage V2 feeds back to the input of the integrator 1.

In this oscillator, the hysteresis comparator 2 outputs a first output voltage VOH when the input voltage V1 from the integrator 1 is larger than a first threshold voltage VTH and a second output voltage VOL when the input voltage V1 from the integrator 1 is smaller than a second threshold voltage VTL. The hysteresis comparator 2 maintains the prior output voltage, either VOH or VOL, when the input voltage from the integrator 1 is between the first and second threshold voltages, i.e., performs the hysteresis characteristics having the voltage difference VTH–VTL.

Figure 5A:
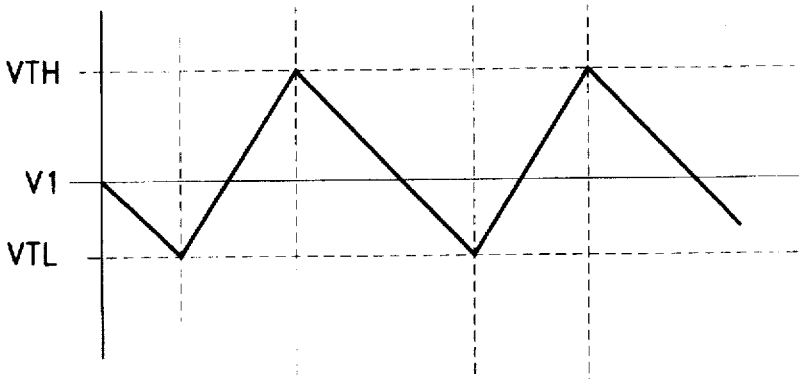
FIG. 5 is a timing chart showing an operation of the fundamental oscillator of FIG. 4.
Figure 5B:
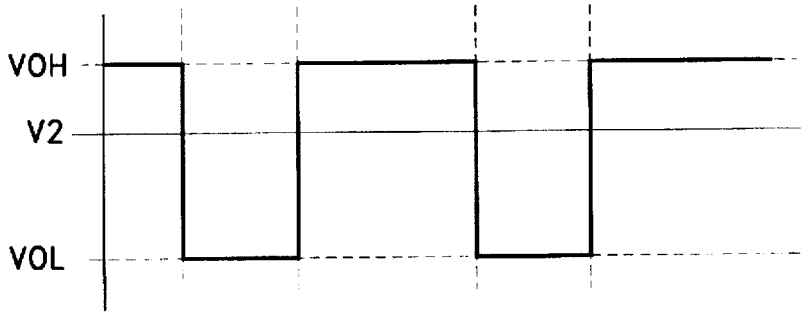
Figure 6:
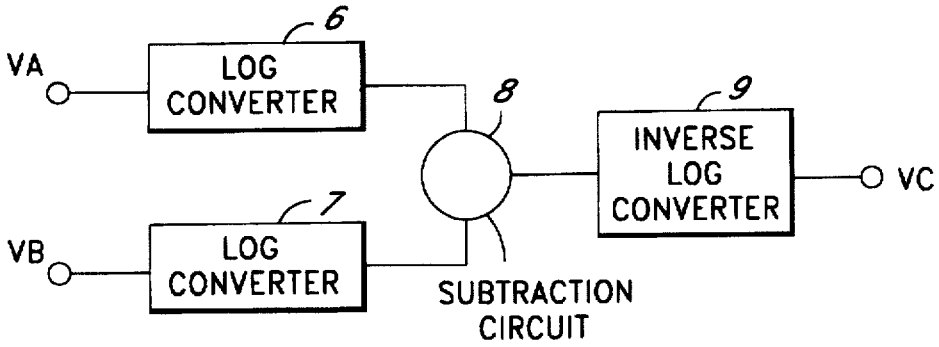
Fig. 6 (PRIOR ART)
FIG. 6 is a block diagram showing an example of conventional analog division circuit.

As shown in FIGS. 5A and 5B, in case where the operation starts when the output voltage V1 of the integrator 1 is 0 volt and thus the output voltage V2 of the hysteresis comparator 2 is VOH, the voltage V1 decreases and reaches the second threshold voltage VTL where the output voltage V2 of the hysteresis comparator 2 changes to the second output voltage VOL.

Then the output V1 of the integrator 1 increases and reaches the first threshold voltage VTH of the hysteresis comparator 2 where the output V2 of the hysteresis comparator 2 changes to the first output voltage VOH. The same procedure repeats so that the oscillation continues wherein the output of the integrator 1 is a triangular wave while the output of the hysteresis comparator 2 is a rectangular wave. In the foregoing oscillation, it is assumed the voltage relationships of VTH>VTL, VOH>0 volt>VOL.

Figure 3:
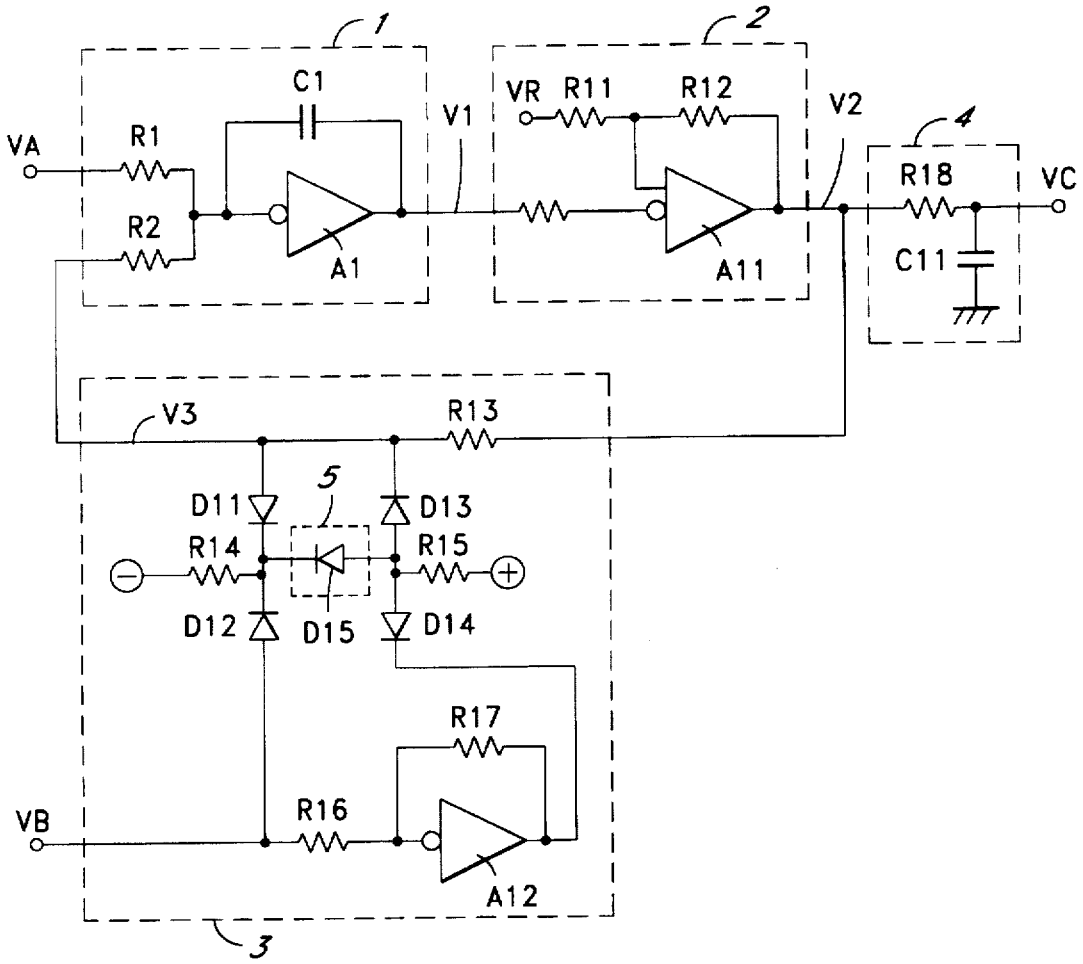
FIG. 3 is a it diagram showing a detailed structure of the analog arithmetic circuit of the present invention.

With reference to FIGS. 1–3, the present invention is describe in detail. An integrator 1 has an operation amplifier A1 and a feedback capacitor C1. The integrator 1 is provided with a dividend VA through an input resistor R1 and a feedback signal voltage V3 through an input resistor R2. The integrator 1 outputs a signal V1 as shown in FIG. 2A to a hysteresis comparator 2.

Figure 4:
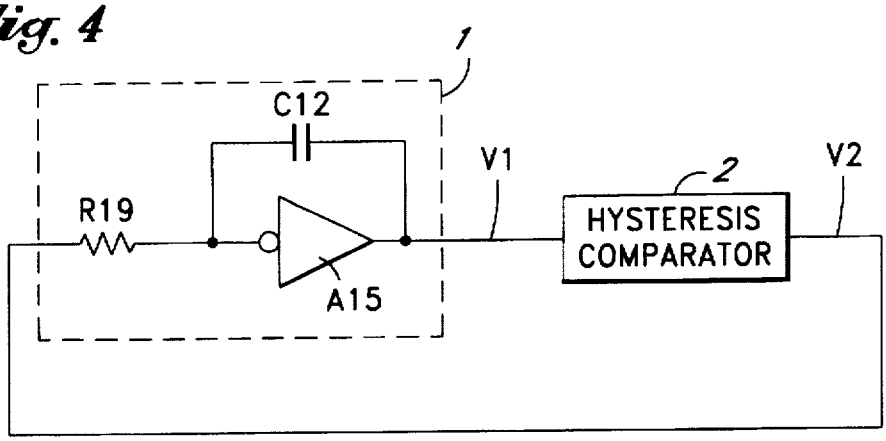
FIG. 4 is a block diagram showing a structure of a fundamental oscillator in the analog arithmetic circuit of FIGS. 1 and 2.

The hysteresis comparator 2 receives the output signal V1 from the integrator 1 and generates an output signal V2 having the first and second output voltages based on the hysteresis characteristics mentioned with reference to FIGS. 4 and 5. The output signal V2 of the hysteresis comparator 2 is shown in FIG. 2B.

A limiter 3 is provided with the output signal V2 of the hysteresis comparator 2 and a divisor VB and generates the feedback signal V3 which is shown in FIG. 2C. The feedback signal V3 is K·VB when the signal V2 is the first output voltage VOH and is –K·VB when the signal V2 is the second output voltage VOL, where K is a positive natural number. By the arrangement of the integrator 1, the hysteresis comparator 2 and the limiter 3, it is formed an oscillator. The output of the hysteresis comparator 2 is averaged by an average circuit 4 which outputs a signal VC (quotient).

The input and output relationship in the integrator 1 is expressed as in the following where a time is T, an initial value of the output signal VI of the integrator 1 is $V_{INT}$.

$$V1=-(VA/R1+K\cdot VB/R2)\cdot T\cdot/C1+V_{INT} \quad (4)$$

In the time periods t1 and t2 of FIG. 2, the threshold voltages are expressed as follows:

$$VTL=-(VA/R1+K\cdot VB/R2)\cdot t1\cdot 1/C1+VTH \quad (5)$$

$$VTH=-(VA/R1-K\cdot VB/R2)\cdot t2\cdot 1/C1+VTL \quad (6)$$

The equations 5 and 6 are arranged with respect to the time periods t1 and t2 as follows:

$$t1=(VTH-VTL)\cdot C1\cdot 1/(VA/R1+K\cdot VB/R2) \quad (7)$$

$$t2=(VTL-VTH)\cdot C1\cdot 1/(VA/R1-K\cdot VB/R2) \quad (8)$$

The input and output relationship in the average circuit 4 is expressed as in the following since the output voltage VOH is provided during the time period ti and the output voltage VOL is provided during the time period t2.

$$VC=(VOH\cdot t1+VOL\cdot t2)/(t1+t2) \quad (9)$$

The equation 9 is also expressed as in the following:

$$VC=(VOH-VOL)\cdot t1/(t1+t2)+VOL \quad (10)$$

When substituting the equation 10 with the time periods t1 and t2 in the equations 7 and 8, the output VC is expressed as in equation 11. Further through the following equations 12–14, the output signal VC of the average circuit 4 is expressed as in the equation 15.

$$VC=(VOH-VOL)\cdot\frac{\dfrac{1}{\left(\dfrac{VA}{R1}+\dfrac{K\cdot VB}{R2}\right)}}{\dfrac{1}{\left(\dfrac{VA}{R1}+\dfrac{K\cdot VB}{R2}\right)}+\dfrac{-1}{\left(\dfrac{VA}{R1}+\dfrac{-K\cdot VB}{R2}\right)}}+VOL \quad (11)$$

$$VC=(VOH-VOL)\cdot\frac{1}{\dfrac{\dfrac{-1}{\left(\dfrac{VA}{R1}+\dfrac{-K\cdot VB}{R2}\right)}}{\dfrac{1}{\left(\dfrac{VA}{R1}+\dfrac{K\cdot VB}{R2}\right)}}+1}+VOL \quad (12)$$

$$VC=(VOH-VOL)\cdot\frac{1}{\dfrac{\dfrac{-1}{\left(\dfrac{-K\cdot VB}{R2}-\dfrac{VA}{R1}\right)}}{\dfrac{1}{\left(\dfrac{-K\cdot VB}{R2}+\dfrac{VA}{R1}\right)}}+1}+VOL \quad (13)$$

$$VAC=(VOH-VOL)\cdot\frac{\dfrac{-K\cdot VB}{R2}+\dfrac{VA}{R1}}{2\cdot\dfrac{-K\cdot VB}{R2}}+VOL \quad (14)$$

$$VC=-0.5\cdot(VOH-VOL)\cdot\frac{R2}{K\cdot R1}\cdot\frac{VA}{VB}+0.5\cdot(VOH+VOL) \quad (15)$$

Here, by setting the parameters VOH, VOL, K, R1 and R2 as in the relationship shown in the equations 16 and 17, the relationship of division is expressed as in the equation 18 wherein VC is a quotient of a dividend –VA which is divided by a divisor VB while VOH is a proportional constant.

$$VOH=-VOL \quad (16)$$

$$K\cdot R1=R2 \quad (17)$$

$$VC=VOH\cdot(-VA)/VB \quad (18)$$

It should be noted that the parameters VA, VB, K, R1 and R2 satisfy the relationship shown in the equation 19.

$$VA/R1<K\cdot VB/R2 \quad (19)$$

FIG. 3 shows a more detailed circuit structure of the analog arithmetic circuit of the present invention. The hysteresis comparator 2 has a positive feedback structure formed of resistors R11 and R12 which are supplied with a reference voltage VR. In this arrangement of hysteresis comparator, as is known in the art, the threshold voltages VTH and VTL and the output voltages VOH and VOL are related one another as follows:

$$VTH=(R11\cdot VOH+R12\cdot VR)/(R11+R12)$$

$$VTL=(R11\cdot VOL+R12\cdot VR)/(R11+R12)$$

The other circuit arrangement of the hysteresis comparator is also available.

An example of the average circuit 4 in FIG. 3 is a simple R-C circuit formed of a resistor R18 and a capacitor C11 as is well known in the art.

An example of the limiter 3 in FIG. 3 includes an operational amplifier A12 and a pair of gates each of which is formed of a pair of diodes. The operational amplifier A12 is connected with resistors R16 and R17 having the same resistance value. Thus, in this example, the operational amplifier A12 and the resistors RIG and R17 form an inverting amplifier. The input of the inverting amplifier is provided with an input voltage VB which is a divisor signal. Thus, the output of the inverting amplifier is −VB.

The diodes D11 and D12 are biased by a negative voltage through a resistor R14. The diodes D13 and D14 are biased by a positive voltage through a resistor R15. It is preferable to select a pair of diodes D11 and D12 or D13 and 14 which have similar operational curves with each other. To provide bias currents, the resistors R14 and R15 have relatively large resistance values. A diode D15 is connected between the common connection points of the diodes D11–D14 as shown in FIG. 3.

When the output signal V2 of the hysteresis comparator 2 is the first output voltage VOH (high level), the gate formed of the diodes D11 and D12 opens so that the voltage VB is transferred to the integrator input as the feedback signal V3. When the output signal V2 of the hysteresis comparator is the second output voltage VOL (low level), the gate formed of the diodes D13 and D14 opens so that the voltage −VB is transferred to the input of the integrator 1 as the feedback signal V3.

In the arrangement of the limiter 3 in FIG. 3, since each of the diodes needs a forward bias voltage (Vd) to conduct, the feedback loop oscillation may not be continued when the input voltage VB is close to zero. The diode D15 is provided to stabilize the operation of the arithmetic circuit in such a situation. The diode D15 conducts when the anode voltage (−VB+Vd) exceeds the cathode voltage (VB−Vd) by the forward bias voltage Vd. Thus, there is a following relationship.

$$(-VB+Vd)-(VB-Vd)>Vd$$

$$-2VB>-Vd$$

$$VB<Vd/2$$

This means that when input voltage VB is smaller than Vd/2, the diode D15 the fixed voltage Vd/2 is provided to the integrator. The oscillation can continue in the analog arithmetic circuit of the present invention.

In the foregoing, the present invention can cancel the errors caused by deviations of circuit components by setting K=V3/VB=R2/R1. As a result, it is able to achieve the arithmetic error smaller than 0.1 without any adjustment circuit or adjustment process.

As has been described in the foregoing, according to the present invention, the analog arithmetic circuit is capable of directly dividing one input voltage by another input voltage without involving a logarithmic conversion process. The analog arithmetic circuit performs a division by a new circuit configuration including an oscillator formed of an integrator, a hysteresis comparator and a limiter.

The analog arithmetic circuit of the present invention can divide one input voltage by another input voltage with high accuracy without using high precision circuit components. Further, the analog arithmetic circuit of the present invention is capable of directly dividing one input voltage by another input voltage with high accuracy without involving any adjustment circuit or process.

What is claimed is:

1. An analog arithmetic circuit, comprising:

an integrator for integrating a dividend signal and a feedback signal;

a hysteresis comparator having two threshold levels to compare an output signal of said integrator and generates a comparison output;

a limiter which receives said comparison output and a divisor signal and generates said feedback signal that is proportional to said divisor signal;

an average circuit connected to an output of said hysteresis comparator to generate an average value of said comparison output as a quotient signal.

2. An analog arithmetic circuit as defined in claim 1, wherein said limiter feedbacks said output of said hysteresis comparator to said integrator so that a closed loop having said integrator, said hysteresis comparator and said limiter forms an oscillator.

3. An analog arithmetic circuit as defined in claim 1, wherein said hysteresis comparator is formed of a positive feedback circuit and a reference voltage to determine a hysteresis voltage which is a difference between said two threshold levels.

4. An analog arithmetic circuit as defined in claim 1, wherein said limiter is formed of an operational amplifier which receives said divisor signal and outputs an inverse polarity signal which has a polarity opposite to that of said divisor signal, and a pair of gates selectively provides either of said divisor signal or said inverse polarity signal as said feedback signal to said integrator.

5. An analog arithmetic circuit as defined in claim 4, wherein said limiter generates said divisor signal when output of said hysteresis comparator is a high voltage and said inverse polarity divisor signal when said output of said hysteresis comparator is a low voltage.

6. An analog arithmetic circuit as defined in claim 4, wherein said limiter further includes means, connected to said pair of gates, for stabilizing an operation of said analog arithmetic circuit when said divisor signal is close to zero volt.

7. An analog arithmetic circuit as defined in claim 6, wherein said stabilizing means is formed of a diode which is connected between said pair of gates.

8. A method of dividing an analog voltage by another analog voltage comprising the following steps of:

applying an input voltage which is a dividend to one input of an integrator;

detecting an output voltage of said integrator and generates a high or low level output voltage which is dependent of the magnitude of said output voltage of said integrator while independent of said output voltage when said output voltage is within a two threshold voltages, feedbacking a voltage which is proportional to another input voltage which is a divisor to another input of said integrator when receiving said high or low level output voltage; and averaging said high or low level output voltage to obtain an average value which is a quotient of said dividing said dividend by said divisor.

* * * * *